US005682185A

United States Patent [19]

Wade et al.

[11] Patent Number: 5,682,185

[45] Date of Patent: Oct. 28, 1997

[54] ENERGY MEASUREMENT SCHEME FOR AN INK JET PRINTER

[75] Inventors: John Wade, Poway; Brian Canfield, San Diego, both of Calif.

[73] Assignee: Hewlett-Packard Company, Palo Alto, Calif.

[21] Appl. No.: 144,942

[22] Filed: Oct. 29, 1993

[51] Int. Cl.[6] ..... B41J 2/05

[52] U.S. Cl. ..... 347/19; 347/57

[58] Field of Search ..... 347/19, 56, 67, 347/14, 57

[56] References Cited

U.S. PATENT DOCUMENTS

| | | | |
|---|---|---|---|
| 4,983,994 | 1/1991 | Mori et al. | 346/76 PH |
| 5,223,853 | 6/1993 | Wysocki et al. | 347/19 |
| 5,235,351 | 8/1993 | Koizumi | 347/14 |

FOREIGN PATENT DOCUMENTS

| | | |
|---|---|---|
| A-394699 | 10/1990 | European Pat. Off. . |
| A-4020885 | 1/1992 | Germany . |

*Primary Examiner*—Joseph W. Hartary
*Assistant Examiner*—Craig A. Hallacher

[57] ABSTRACT

A method for operating a thermal ink jet printer including a printhead having a sample resistor and ink firing heater resistors responsive to pulses provided to the printhead. The resistance of a sample resistor is read and the pad to pad resistance of the printhead is determined. The operating energy of the printhead is determined from a look-up table and the target power is determined from the target pulse width. The power supply voltage is determined from the target power and the power supply voltage is set. The operating power is determined and the operating pulse width is set based on the operating power and target energy.

4 Claims, 3 Drawing Sheets

ENERGY MEASUREMENT SCHEME FOR AN INK JET PRINTER

CROSS-REFERENCE TO RELATED APPLICATIONS

The present invention is related to the following pending and commonly assigned U.S. patent application: THERMAL TURN ON ENERGY TEST FOR AN INKJET PRINTER, by John Wade, et al., filed Oct. 29, 1993, attorney docket number 1092602-1 which is herein incorporated by reference.

BACKGROUND OF THE INVENTION

The subject invention relates generally to thermal ink jet printers, and is directed more particularly to a technique for determining and setting the operating energy of a thermal ink jet printhead while the printhead is installed in a printer.

An ink jet printer forms a printed image by printing a pattern of individual dots at particular locations of an array defined for the printing medium. The locations are conveniently visualized as being small dots in a rectilinear array. The locations are sometimes called "dot locations", "dot positions", or "pixels". Thus, the printing operation can be viewed as the filling of a pattern of dot locations with dots of ink.

Ink jet printers print dots by ejecting very small drops of ink onto the print medium, and typically include a movable carriage that supports one or more printheads each having ink ejecting nozzles. The carriage traverses over the surface of the print medium, and the nozzles are controlled to eject drops of ink at appropriate times pursuant to command of a microcomputer or other controller, wherein the timing of the application of the ink drops is intended to correspond to the pattern of pixels of the image being printed.

The printheads of thermal ink jet printers are commonly implemented as replaceable printhead cartridges which typically include one or more ink reservoirs and an integrated circuit printhead that includes a nozzle plate having an array of ink ejecting nozzles, a plurality of ink firing chambers adjacent respective nozzles, and a plurality of heater resistors adjacent the firing chambers opposite the ink ejecting nozzles and spaced therefrom by the firing chambers. Each heater resistor causes an ink drop to be fired from its associated nozzle in response to an electrical pulse of sufficient energy.

Color inkjet printers commonly employ a plurality of print cartridges, usually either two or four, mounted in the printer carriage to produce a full spectrum of colors. In a printer with four cartridges, each print cartridge contains a different color ink, with the commonly used base colors being cyan, magenta, yellow, and black. In a printer with two cartridges, one cartridge usually contains black ink with the other cartridge being a tri-compartment cartridge containing the base color cyan, magenta and yellow inks. The base colors are produced on the media by depositing a drop of the required color onto a dot location, while secondary or shaded colors are formed by depositing multiple drops of different base color inks onto the same dot location, with the overprinting of two or more base colors producing the secondary colors according to well established optical principles.

Thermal ink jet pens require an electrical drive pulse from a printer in order to eject a drop of ink. The voltage amplitude, shape and width of the pulse affect the pen's performance. It is desirable to operate the pen using pulses that deliver a specified amount of energy. The energy delivered depends on the pulse characteristics (width, amplitude, shape), as well as the resistance of the pen.

A thermal ink jet printhead requires a certain minimum energy to fire ink drops of the proper volume (herein called the turn on energy). Turn on energy can be different for different printhead designs, and in fact varies among different samples of a given printhead design as a result of manufacturing tolerances. In an integrated driver type pen, the total resistance consists of the heater resistance in series with a field effect transistor and other trace resistances, each of which has an associated manufacturing tolerance. These tolerances add to the uncertainty in knowing how much energy is being delivered to any given pen. It is necessary, therefore, to deliver more energy to the average pen than is required to fire it (called "over energy") in order to allow for this uncertainty, but since it is known that excessive amounts of energy have adverse effects, such as reduced heater resistor life, it is necessary to place an upper bound on over energy. This has the effect of limiting the range of manufacturing tolerances that are acceptable, which could have an adverse effect on pen yield and manufacturing cost. As a result, thermal ink jet printers are configured to provide a fixed ink firing energy that is greater than the expected lowest turn on energy for the printhead cartridges it can accommodate.

A consideration with utilizing a fixed ink firing energy is that firing energies excessively greater than the actual turn on energy of a particular printhead cartridge result in a shorter operating lifetime for the heater resistors and degraded print quality. Another consideration with utilizing a fixed ink firing energy is the inability to utilize newly developed or revised printheads that have ink firing energy requirements that are different from those for which existing thermal ink jet printers have been configured.

It would therefore be an advantage to provide a thermal ink jet printer that determines the pad-to-pad resistance and the thermal turn on energy of a thermal ink jet printhead while the printhead is installed in the printer.

Accordingly, it is a purpose of this invention to reduce the pen resistance uncertainty, and thereby allow the printer to deliver a reduced average over energy which reduces the pen tolerance constraints and improves yields and costs.

SUMMARY OF THE INVENTION

The foregoing and other advantages are provided by the apparatus and method of the present invention for operating a thermal ink jet printer. In accordance with this invention, the integrated circuit printhead of the thermal ink jet printhead includes a sample resistor having a precisely defined resistance ratio relative to each of the firing heater resistors. The sample resistor is utilized to determine the pad to pad resistance associated with the heater resistors in order to determine the energy provided to the heater resistors as a function of the voltage of the pulses provided by the driver circuit. Since the controller knows the pen resistance within a small tolerance, it is able to deliver a known amount of energy, also within a small tolerance. It does this by performing the steps of: reading the resistance of a sample resistor; determining the pad to pad resistance of the printhead; determining the target operating energy and target pulse width of the printhead from a look-up table; computing a target operating power from the target operating energy and target pulse width; determining a power supply voltage from the target operating power and the pad to pad resistance; setting a power supply voltage; determining an operating power; and setting the operating pulse width based on operating power and target energy.

BRIEF DESCRIPTION OF THE DRAWINGS

The advantages and features of the disclosed invention will readily be appreciated by persons skilled in the art from the following detailed description when read in conjunction with the drawing wherein.

DETAILED DESCRIPTION OF THE DISCLOSURE

Figure 1:
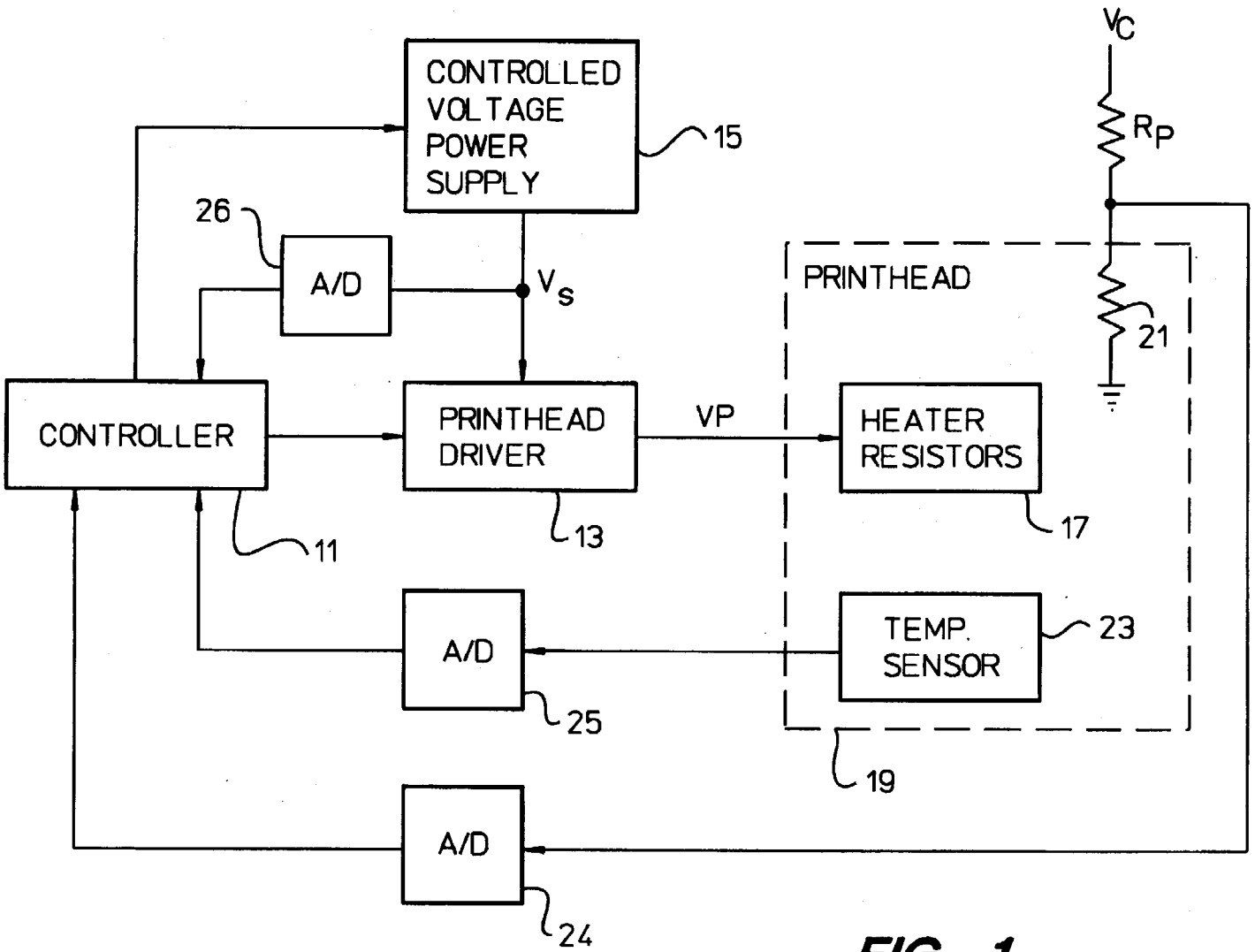
FIG. 1 is a schematic block diagram of the thermal ink jet components for implementing the invention.

In the following detailed description and in the several figures of the drawing, like elements are identified with like reference numerals.

Referring now to FIG. 1, shown therein is a simplified block diagram of a thermal ink jet printer that employs the techniques of the invention. A controller 11 receives print data input and processes the print data to provide print control information to a printhead driver circuit 13. A controlled voltage power supply 15 provides to the printhead driver circuit 13 a controlled supply voltage $V_s$ whose magnitude is controlled by the controller 11. The printhead driver circuit 13, as controlled by the controller 11, applies driving or energizing voltage pulses of voltage VP to a thin film integrated circuit thermal ink jet printhead 19 that includes thin film ink drop firing heater resistors 17. The voltage pulses VP are typically applied to contact pads that are connected by conductive traces to the heater resistors and, due to their resistance, the pulse voltage received by an ink firing resistor is typically less than the pulse voltage VP at the printhead contact pads. Since the actual voltage across a heater resistor cannot be readily measured, turn on energy for a heater resistor as described herein will be with reference to the voltage applied to the contact pads of the printhead cartridge associated with the heater resistor. The resistance associated with a heater resistor will be expressed in terms of pad to pad resistance of a heater resistor and its interconnect circuitry (i.e., the resistance between the printhead contact pads associated with a heater resistor).

The relation between the pulse voltage VP and the supply voltage $V_s$, will depend on the characteristics of the driver circuitry. For example, the printhead driver circuit can be modelled as a substantially constant voltage drop $V_d$, and for such implementation the pulse voltage VP is substantially equal to the supply voltage $V_s$ reduced by the voltage drop $V_d$ of the driver circuit:

$$VP=V_s-V_d \quad \text{(Equation 1)}$$

If the printhead driver is better modelled as having a resistance $R_d$, then the pulse voltage is expressed as:

$$VP=V_s(R_{pp}/(R_d+R_{pp})) \quad \text{(Equation 2)}$$

wherein $R_{pp}$ is the pad to pad resistance associated with a heater resistor.

The controller 11, which can comprise a microprocessor architecture in accordance with known controller structures, more particularly provides pulse width and pulse frequency parameters to the printhead driver circuitry 13 which produces drive voltage pulses of the width and frequency as selected by the controller, and with a voltage VP that depends on the supply voltage $V_s$ provided by the voltage controlled power supply 15 as controlled by the controller 11. Essentially, the controller 11 controls the pulse width, frequency, and voltage of the voltage pulses applied by the driver circuit to the heater resistors. As with known controller structures, the controller 11 would typically provide other functions such as control of the printhead carriage (not shown) and control of movement of the print media.

In accordance with this invention, the integrated circuit printhead of the thermal ink jet printer of FIG. 1 further includes a sample resistor 21 having a precisely defined resistance ratio relative to each of the heater resistors, which is readily achieved with conventional integrated circuit thin film techniques. By way of illustrative example, the resistance sample resistor and its interconnect circuit are configured to have a pad to pad resistance $R_{pp}$ that is the sum of (a) 10 times the resistance of each of the heater resistors and (b) the resistance of an interconnect circuit for a heater resistor. One terminal of the sample resistor 21 is connected to ground while its other terminal is connected to one terminal of a precision reference resistor that is external to the printhead and has its other terminal connected to a voltage reference $V_c$. The junction between the sample resistor 21 and the precision resistor $R_p$ is connected to an analog-to-digital converter 24. The digital output of the A/D converter 24 comprises quantized samples of the voltage at the junction between the sample resistor 21 and the precision resistor $R_p$. Since the value of the precision resistor $R_p$ is known, the voltage at the junction between the sample resistor 21 and the precision resistor $R_p$ is indicative of the pad to pad resistance $R_{pp}$ of the sample resistor 21 which in turn is indicative of the resistance of the heater resistors. The sample resistor 21 can be utilized to determine the pad to pad resistance $R_{pp}$ associated with the heater resistors in order to determine the energy provided to the heater resistors as a function of the voltage VP of the voltage pulses provided by the driver circuit. This arrangement allows the printer mechanism to measure the resistance of the string and by employing an empirically determined regression, determine with high accuracy the overall pen resistance. This is true because the heater resistors which constitute the largest portion of the pen's resistance uncertainty are closely represented by the sample resistor. Since the printer knows the pen resistance within a small tolerance, it is able to deliver a known amount of energy, also within a small tolerance. It does this by adjusting its voltage and/or pulse width to appropriate values.

The integrated circuit printhead of the thermal ink jet printer of FIG. 1 also includes a temperature sensor 23 located in the proximity of some of the heater resistors, and provides an analog electrical signal representative of the temperature of the integrated circuit printhead. The analog output of the temperature sensor 23 is provided to an analog-to-digital (A/D) converter 25 which provides a digital output to the controller 11. The digital output of the A/D converter 25 comprises quantized samples of the analog output of the temperature sensor 23. The output of the A/D converter is indicative of the temperature detected by the temperature sensor.

For the particular implementation wherein the printer of FIG. 1 is configured to print pursuant to application of ink firing voltage pulses having a fixed frequency and a fixed pulse width, the pulse energy of the voltage pulses will depend on the pad to pad resistance $R_{pp}$ associated with each of the heater resistors and the pulse voltage VP of the voltage pulses as determined by the supply voltage $V_s$ and the voltage drop across the driver circuit $V_d$. The pad to pad resistance $R_{pp}$ associated with the heater resistors can be determined by the controller 11 pursuant to reading the sample resistor 21, and thus a reference pulse voltage can be determined from the relation that energy is power multiplied by time, wherein time is the operating pulse width. Power can be particularly expressed as voltage squared divided by resistance, wherein resistance is the pad to pad resistance $R_{pp}$ associated with each heater resistor, and thus the reference pulse energy can be expressed in terms of the pad to pad resistance $R_{pp}$ and the reference pulse voltage necessary to achieve the reference energy.

By determining a reference pulse voltage that would result in a pulse energy equal to a reference pulse energy for a fixed pulse width effectively calibrates the printhead such that the pulse energy provided to the heater resistors is known and can be varied by changing the supply voltage $V_s$ which controls the pulse voltage VP.

A single pen's voltage can be independently set, but for a set of pens using a common power supply, a single pen voltage must be set which is satisfactory for all the pens using the shared power supply. Pens sharing a common power supply can be controlled by varying the pulse widths of the pens on the shared power supply. Differences in the pen $R_{pp}$ values result in differences in pen pulse power, with the lower resistance delivering the higher pulse power. One of the pens is set to the target voltage, meaning that the other pens need different widths in order to deliver the target pulse energy.

Figure 2:
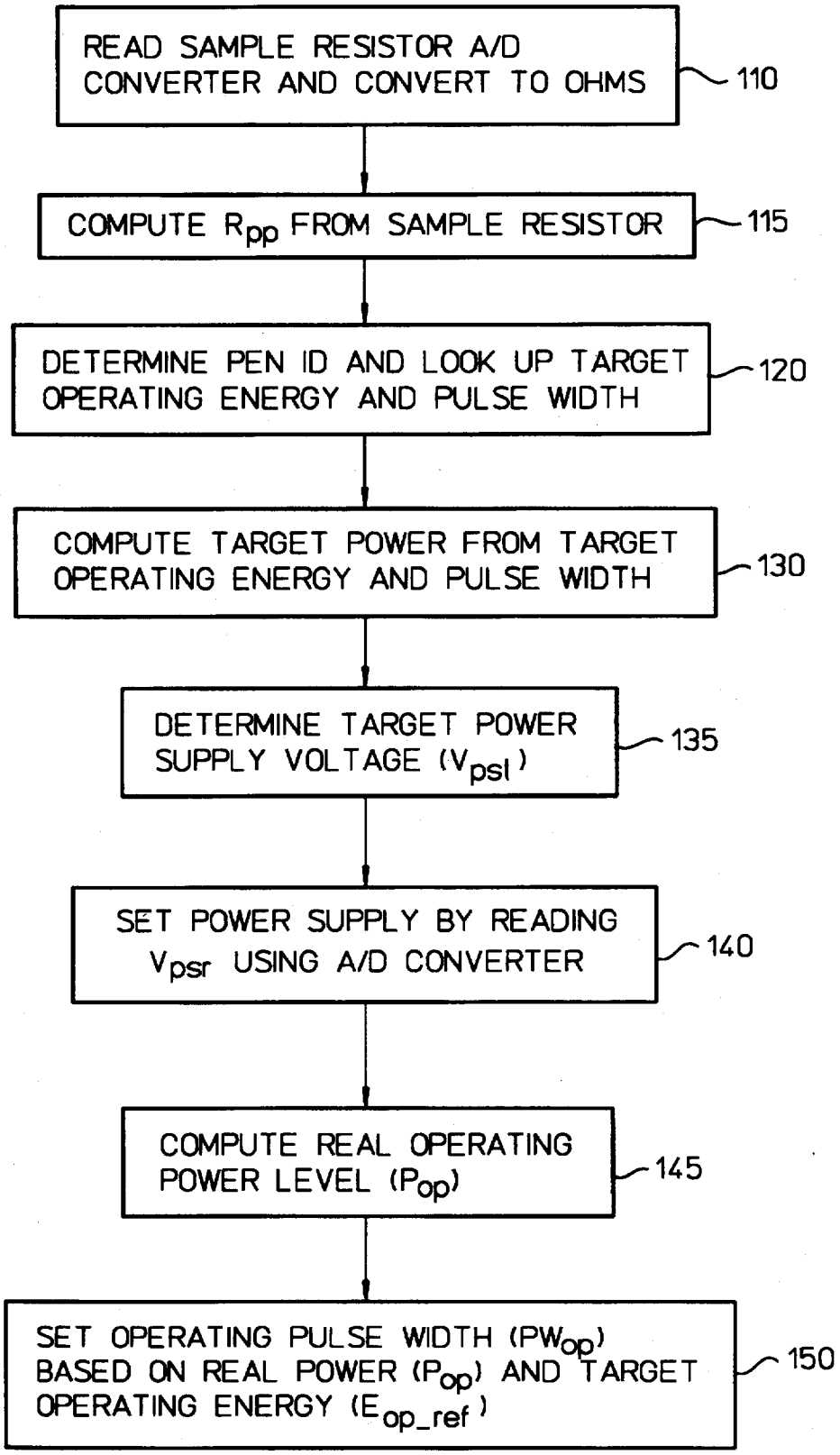
FIG. 2 is a flow diagram of a procedure for setting an operating energy for a pen driven from a single power supply in accordance with the present invention.

Referring now to FIG. 2, set forth therein is a flow diagram of a procedure in accordance with the invention for determining the pad to pad resistance and the operating energy of a single pen in accordance with the invention. At 110 the resistance of the sample resistor 21 is determined by reading A/D 24 and converting the reading to ohms. At 115 the pad to pad resistance $R_{pp}$ is computed from the resistance of the sample resistor $R_{sample}$ by the equation $R_{pp}=K_1*R_{sample}+K_2$ wherein $K_1$ and $K_2$ are constants determined by performing a regression analysis. At 120 the controller 11 uses the pen's identification information and a look-up table to determine the pen's target operating energy, $E_{op_ref}$ and target pulse width $PW_{op_ref}$. At 130 the target power, $P_{op_ref}$, is computed using the known target pulse width, $PW_{op_ref}$ and target operating energy $E_{op_ref}$, using the formula, $P_{op_ref}=E_{op_ref}/PW_{op_ref}$. At 135 the target power supply voltage, $V_{psr}$, is determined from the target operating power $P_{op_ref}$ and the pad to pad resistance $R_{pp}$ using the formula, $V_{psr}=V_{dn}+[P_{op_ref}*R_{pp}]^{1/2}$, wherein $V_{dn}$ is the nominal voltage of the driver system. At 140 the power supply is set to its closest value and $V_s$, is read using the an A/D 26. At 145 the real operating power level is computed using the formula $P_{op}=(V_s-V_{dn})^2/R_{pp}$. At 150 the operating pulse width $PW_{op}$, is set based on the real operating power and the target energy using the formula, $PW_{op}=E_{op_ref}/P_{op}$.

Figure 3:
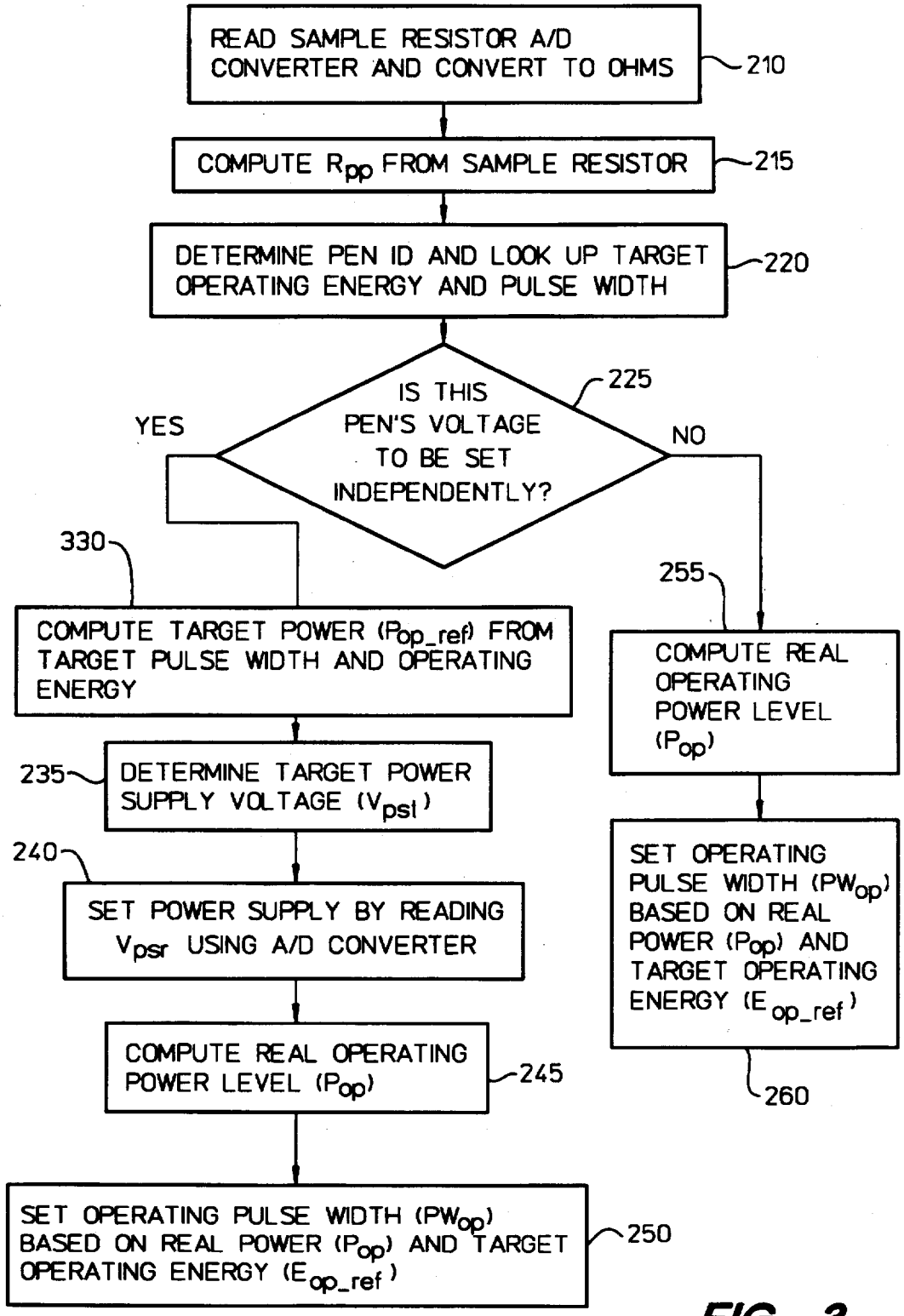
FIG. 3 is a flow diagram of a procedure for setting an operating energy for a pen set driven from a single power supply in accordance with the present invention.

Referring now to FIG. 3, set forth therein is a flow diagram of a procedure in accordance with this invention for determining the pad to pad resistances and the operating energy of a set of pens using a common power supply in accordance with this invention. At 210 the resistance of the sample resistor 21 is determined by reading A/D 24 and converting the reading to ohms. At 215 the pad to pad resistance $R_{pp}$ is computed from the resistance of the sample resistor $R_{sample}$ by the equation $R_{pp}=K_1*R_{sample}+K_2$ wherein $K_1$ and $K_2$ are constants determined by performing a regression analysis. At 220 the controller 11 uses the pen's identification information and a look-up table to determine the pen's target operating energy, $E_{op_ref}$ and target pulse width $PW_{op_ref}$.

At 225 the pen that will have its voltage independently set is determined. If the criteria were to limit the power in order to ensure long resistor life while wanting the pulse width as short as possible for print quality, the pen with the lowest pad to pad resistance would be independently optimized. If the criteria were different, a different pen could be chosen for optimization.

For the pen to be independently set control goes to 230 where the target power, $P_{op_ref}$, is computed from the known target pulse width, $PW_{op_ref}$ and target operating energy $E_{op_ref}$, using the formula, $P_{op_ref}=E_{op_ref}/PW_{op_ref}$. At 235 the target power supply voltage, $V_{psr}$, is determined from the target operating power $P_{op_ref}$ and the pad to pad resistance $R_{pp}$ using the formula, $V_{psr}=V_{dn}+[P_{op_ref}*R_{pp}]^{1/2}$, wherein $V_{dn}$ is the nominal voltage of the driver system. At 240 the power supply is set to its closest value and $V_{psr}$ is read using the A/D. At 245 the real operating power level is computed using the formula $P_{op}=(V_{psr}-V_{dn})^2/R_{pp}$. At 250 the operating pulse width, $PW_{op}$, is set based on the real operating power and the target energy using the formula, $PW_{op}=E_{op_ref}/P_{op}$.

Referring back to 225 for the pens which will not be independently set, control goes to 255 where the real operating power level is computed using the formula $P_{op}=(V_{psr}-V_{dn})^2/R_{pp}$. At 260 the operating pulse width, $PW_{op}$, is set based on the real operating power and the target energy of the independently set pen using the formula, $PW_{op}=E_{op_ref}/P_{op}$. The method of the present invention can be performed very quickly with the pen carriage positioned anywhere. The pen energies are set at power-on and after a pen is changed.

The objective is to set the pen voltages and pulse widths so as to reliably fire the pens while maintaining the pen life. The present invention allows the setting of the operating energy at a value greater than the turn on energy, but within a range that insures proper print quality while avoiding premature failure of the heater resistors.

The foregoing has been a disclosure of a thermal ink jet printer that advantageously determines an operating energy while allowing a wide tolerance band for pen resistance of a thermal ink jet printhead while the printhead is installed in the printer and operates at a pulse energy that is based on the determined turn on energy. Pursuant to the invention, print quality and useful printhead life are optimized.

Although the foregoing has been a description and illustration of specific embodiments of the invention, various modifications and changes thereto can be made by persons skilled in the art without departing from the scope and spirit of the invention as defined by the following claims.

What is claimed is:

1. A method for operating a thermal ink jet printer having a printhead with ink firing heater resistors responsive to pulses provided to the printhead by a printhead driver that is responsive to a power supply, comprising the steps of:

measuring a pad to pad resistance of the printhead;

reading a target operating energy and pulse width from a look-up table;

computing a target power from the target operating energy and pulse width;

calculating a power supply voltage from the measured pad to pad resistance and the target power;

setting the power supply to provide a voltage that is approximately equal to the calculated power supply voltage;

determining an operating power from the actual voltage provided by the power supply;

selecting an operating pulse width based on the operating power and the target energy.

2. A method for operating a thermal ink jet printer having a printhead with ink firing heater resistors responsive to pulses provided to interconnecting pads for the heater resistors by a printhead driver which receives a supply voltage from a power supply, comprising the steps of:

measuring a pad to pad resistance of the print-head that is representative of the interconnect pad to interconnect pad resistance of each of the ink firing resistors;

detecting a target operating energy and a target pulse width for the printhead;

computing a target power from the target operating energy and the target pulse width;

calculating from the pad to pad resistance and the target power a target power supply voltage that will cause the printhead driver to provide the target power with the target pulse width to the interconnect pads for the heater resistors;

setting the power supply to provide a voltage that is approximately equal to the target power supply voltage;

measuring the actual voltage provided by the power supply;

determining an actual operating power from the measured actual power supply voltage and the measured pad to pad resistance; and selecting an operating pulse width based on the actual operating power and the target operating energy.

3. The method of claim 2 wherein the step of detecting a target operating energy and a target pulse width comprises the step detecting a target operating energy and a target pulse width from a look-up table.

4. An inkjet printer comprising:

an inkjet printhead including a plurality of ink firing resistors having a firing resistor resistance associated therewith;

a controlled voltage supply for providing a supply voltage;

a printhead driver responsive to said supply voltage for applying voltage pulses to said ink firing resistors;

a sample resistor having a sample resistor resistance having a predetermined relationship to said firing resistor resistance;

means for sampling said sample resistor to measure said firing resistor resistance;

means for detecting a target operating energy and a target pulse width for the printhead;

means for computing a target power from the target operating energy and the target pulse width;

means for calculating from the measured firing resistor resistance and the target power a target power supply voltage that will cause the printhead driver to provide the target power with the target pulse width to the interconnect pads for the heater resistors;

means for setting the controlled voltage supply to provide a voltage that is approximately equal to the target power supply voltage;

means for measuring the actual voltage provided by the power supply;

means for determining an actual operating power from the measured actual power supply voltage and the measured firing resistor resistance; and means for selecting an operating pulse width based on the actual operating power and the target operating energy.

* * * * *

UNITED STATES PATENT AND TRADEMARK OFFICE

CERTIFICATE OF CORRECTION

PATENT NO. : 5,682,185

DATED : October 28, 1997

INVENTOR(S) : John Wade, et. al.

It is certified that error appears in the above-identified patent and that said Letters Patent is hereby corrected as shown below:

Title page, item [54] and col. 1, line 1, delete "MEASUREMENT" and insert --MANAGEMENT--.

At Column 4, line 25, after "reference resistor" insert --$R_p$--.

Signed and Sealed this

Tenth Day of February, 1998

*Attest:*

*Attesting Officer*

BRUCE LEHMAN

*Commissioner of Patents and Trademarks*